US006675628B2

(12) United States Patent
Nakagawa

(10) Patent No.: US 6,675,628 B2
(45) Date of Patent: Jan. 13, 2004

(54) PUNCH PRESS

(75) Inventor: Atsushi Nakagawa, Aichi (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 10/191,325

(22) Filed: Jul. 10, 2002

(65) Prior Publication Data

US 2003/0029218 A1 Feb. 13, 2003

(30) Foreign Application Priority Data

Jul. 27, 2001 (JP) ..... 2001-227755
Oct. 31, 2001 (JP) ..... 2001-334027

(51) Int. Cl.[7] ..... B21D 43/02

(52) U.S. Cl. ..... 72/421; 72/20.1; 72/20.3; 100/48; 100/216

(58) Field of Search ..... 72/20.1, 20.2, 72/20.3, 21.2, 31.11, 420, 421, 425, 441, 443; 100/43, 48, 216, 257; 83/74, 76, 222, 240

(56) References Cited

U.S. PATENT DOCUMENTS 4,653,311 A * 3/1987 Tack, Jr. ..... 72/443
5,033,342 A * 7/1991 Nordlof ..... 83/73
5,231,860 A * 8/1993 Tsuruta et al. ..... 72/20.1
5,673,585 A * 10/1997 Bishop ..... 72/447
5,915,293 A * 6/1999 Welsh et al. ..... 100/35

FOREIGN PATENT DOCUMENTS

JP 2001-198632 7/2001

* cited by examiner

*Primary Examiner*—Ed Tolan
(74) *Attorney, Agent, or Firm*—Westerman, Hattori, Daniels & Adrian, LLP

(57) ABSTRACT

To provide a punch press which can realize the high hit rate and the energy saving in the punch drive. A plate material transfer control means 32 and a ram axis control means 33 controlled synchronously are provided. The plate material is started to transfer when a punch tool 6 reaches a pullout height HH2 after punching and it is arranged to come to a height HH1 which is likely to contact with the plate material when completing transferring the plate material. The ram axis control means 33 rotates a servomotor 19 in one direction. Moreover, the ram axis control means 33 controls in a motor speed pattern VP based on the distance of transferring the plate material after the punch tool 6 goes up from the pullout height HH2 and the servomotor 19 is prevented from stopping as possible. The motor speed pattern VP is made to be a trapezoid pattern that the acceleration is constant.

8 Claims, 7 Drawing Sheets

PUNCH PRESS

FIELD OF THE INVENTION

The present invention relates to a punch press which makes holes in a plate material and forms it after moving the plate material to a punching process part.

BACKGROUND OF THE INVENTION

An NC unit usually controls the punch press to punch the plate material after stopping it at the predetermined process position, however the cycle time becomes longer and the hit rate becomes lower if waiting for the plate material to be completely stopped.

As illustrated in a plate material transfer speed and a motor speed in driving a ram of FIG. 9, the punch motion is started and the punch goes down before a table unit stops to transfer the plate material for improving the above problem. Additionally, as illustrated in a crank angle of FIG. 8, this is an example of reciprocating a crank mechanism. The crank mechanism is reciprocated between a waiting position HH1' in front of contacting a punch tool with the plate material and a pullout position HH2' wherein the punch tool is apart from the plate material after punching through a bottom dead center BDC but it does not pass through a top dead center TDC.

There is a problem in the above control that the ram must be accelerated rapidly and the energy in driving the motor is increased though the hit rate is improved.

SUMMARY OF THE INVENTION

It is an object of the present invention to provide a punch press which can realize high hit rate and energy saving in a punch drive.

It is another object of the present invention to realize high hit rate and energy saving by the simple control wherein the calculation load in a control system is low.

It is a further object of the present invention that a ram can move up and down smoothly when not punching and it excels at absorbing vibration and shock.

It is an additional object of the present invention to provide a plate material transfer/punch motion control program which can realize high hit rate and energy saving in the punch drive.

The present invention will be described with reference to FIG. 1 corresponding to a preferred embodiment of the present invention. This punch press makes holes and/or forms with a punch tool 6. This punch press comprises a plate material transfer means 3 for transferring a plate material W, a punch drive means 9 having a rotational/linear motion conversion mechanism 20 that converts the rotation of a servomotor 19 into the rise and fall of a ram 8 which makes the servomotor 19 a driving force and moves the punch tool 6 up and down by the ram 8, a plate material transfer control means 32 which controls the plate material transfer means 3, and a ram axis control means 33 which controls the punch drive means 9.

The plate material transfer control means 32 controls the plate material transfer means 3 so as to start to transfer the plate material when the punch tool 6 moves up to a pullout height HH2 not contacting with the plate material W after punching the plate material W.

The ram axis control means 33 rotates the servomotor 19 in one direction, the punch tool 6 is controlled so as to reach a height HH1 which is likely to contact with the plate material when the plate material transfer means 3 completes to transfer the plate material and a motor speed pattern VP that is a rotating speed pattern of the servomotor 19 when the punch tool 6 goes up from the non-contact pullout height HH2 to the height HH1 which is likely to contact with the plate material through a top dead center TDC is generated based on a distance D of transferring the plate material, in said pattern the motor speed not being zero when the distance D of transferring the plate material is under the predetermined distance. Additionally in the motor speed pattern VP, it is preferable to come to the set speed in order for the punch tool 6 to punch when the plate material is completed to transfer and the punch tool 6 reaches the height HH1 which is likely to contact with the plate material. The rotational/linear motion conversion mechanism 20 is a crank mechanism and an eccentric cam mechanism, for example.

According to this configuration, the plate material transfer control means 32 and the ram axis control means 33 starts to transfer the plate material W when the punch tool 6 goes up to the pullout height HH2 not contact with the plate material W and the plate material transfer means 3 and the ram axis control means 33 are controlled synchronously such that the punch tool 6 reaches the height HH1 which is likely to contact with the plate material when completing transferring the plate material, so that the unnecessary waiting time is not produced and the hit rate is improved. Moreover, the ram axis control means 33 rotates the servomotor 19 in one direction and the motor speed pattern VP from the non-contact pullout height HH2 to the height HH1 which is likely to contact with the plate material is generated based on the distance D of transferring the plate material, in said pattern the motor speed not being zero when the distance D of transferring the plate material is under the predetermined distance, so that it can be rotated continuously so as not to stop the servomotor 19. Consequently, the load in accelerating and deaccelerating the speed is low and the accelerating and deaccelerating energy can be low. Thus, high hit rate and energy saving in the punch drive can be realized together.

The above predetermined distance is optional, however it cannot be set directly at distance value and it can be the distance predicted by setting the method of generating the motor speed pattern VP, for example.

Additionally, though the forming part is processed so as to protrude to the upper surface side in general in case of forming with the punch tool 6, the height HH1 which is likely to contact with the plate material and the non-contact pullout height HH2 are set in the position on the upper surface side of the plate material far from the position in the case of making holes as such a forming part is protruded.

The ram axis control means 33 can make the motor speed pattern VP according to the distance D of transferring the plate material a pattern that the acceleration in accelerating and deaccelerating is constant regardless of the distance D of transferring the plate material.

When the acceleration is constant, the load for calculating the motor speed pattern VP based on the distance D of transferring the plate material can be low by the punch drive means 9 and the high hit rate and energy saving can be realized by the simple control.

The motor speed pattern VP can have the constant speed pattern. When the motor speed pattern VP is made to be a curved line which switches from the deacceleration to the acceleration in V-shaped, the vibration and shock is generated in switching. It is not preferable to generate such vibration and shock when not punching as it is wasteful to generate the vibration etc. When having the constant speed pattern, such a rapid change in speed is not generated, the ram can move up and down smoothly when not punching and it excels at absorbing the vibration and shock.

The plate material transfer/punch motion control program of the present invention is provided for working a computer becoming a means for controlling the punch press as the next plate material transfer control means 32 and the ram axis control means 33.

The above punch press, making holes and/or forming with the punch tool 6, comprises the plate material transfer means 3 which transfers the plate material W and the punch drive means 9 which has the rotational/linear motion conversion mechanism 20 which converts the rotation of this servomotor 19 into the rise and fall of the ram 8 and moves the punch tool 6 up and down with the ram 8 by making the servomotor 19 as the driving force.

The plate material transfer control means 32 and the ram axis control means 33 composed by the above plate material transfer/punch motion control program have the means for having the following function.

The above plate material transfer control means 32 controls the plate material transfer means 3 so as to start to transfer the plate material when the punch tool 6 goes up to the pullout height HH2 not contact with the plate material W after punching the plate material W.

The ram axis control means 33 for controlling the punch drive means 9 rotates the servomotor 19 in one direction, controls such that the punch tool 6 reaches the height HH1 which is likely to contact with the plate material when the plate material transfer means 32 completes to transfer the plate material and the motor speed pattern VP when the punch tool 6 goes up from the non-contact pullout height HH2 to the height HH1 which is likely to contact with the plate material through the top dead center TDC is generated based on the distance D of transferring the plate material, in said pattern the motor speed not being zero if the distance D of transferring the plate material is under the predetermined distance. The motor speed pattern VP can have the constant speed pattern.

A recording medium of the present invention can be read by the computer, which records this plate material transfer/punch motion control program.

The plate material transfer/punch motion control program as in claim 6 of the present invention will be described with reference to FIG. 7. This plate material transfer/punch motion control program is executed in the computer which becomes a means for controlling the punch press along with a process program wherein a plate material transfer command for transferring the site of punching the plate material to the ram position is written in the block and it includes the following steps.

More specifically, this plate material transfer/punch motion control program comprises the steps of:

reading the look-ahead block that is the somethingth block from the running program as the control of the actual machine motion in the above process program (S2);

calculating the (expected) plate transfer distance of this read look-ahead block from the block (S3);

generating and memorizing the speed pattern in transferring the plate material of the look-ahead block from this calculated plate material transfer distance (S4);

calculating the plate material transfer time of the look-ahead block from the speed pattern in transferring this generated plate material (S6);

setting the motion time of the ram of the punch drive means in the look-ahead block from this calculated plate material transfer time (S7);

generating and memorizing the motor speed pattern of the ram motion when no contacting such that the non-contact ram motion that the ram reaches the height which is likely to contact with the plate material through the top dead center after the punch tool goes up to the pullout height not contact with the plate material after processing the plate material by rotating the servomotor driving the ram in one direction is implemented in the above calculated ram motion time and the motor speed is not zero when this ram motion time is under the set time (S8); and, starting to transfer the plate material by the speed pattern in transferring the above plate material when the punch tool goes up to the pullout height after processing the plate material by using the generated speed pattern in transferring the plate material and the motor speed pattern in operating the ram when executing so as to control the actual machine motion by the look-aheadblock (S9~S11).

The recording medium as described in claim 7 of the present invention records the plate material transfer/punch motion control program as described in claim 6 of the present invention and can be read by the computer.

DETAILED DESCRIPTION OF THE PREFERRED EMBODIMENTS

A preferred embodiment of the present invention will be described with reference to FIG. 1 to FIG. 4.

As described in FIG. 1, this punch press comprises a punch press body 1 and a control unit 2 controlling the punch press body 1.

Figure 2:
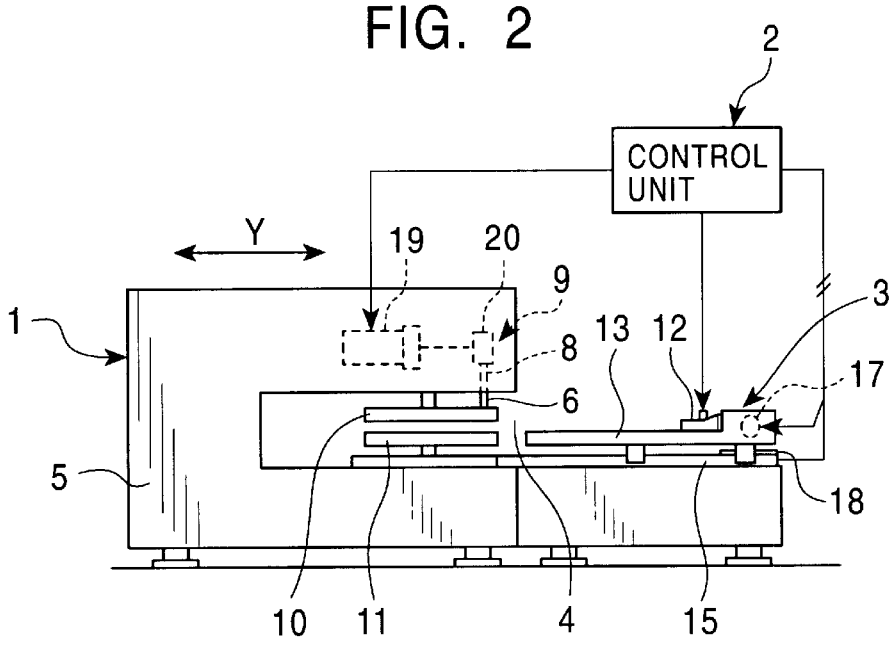
FIG. 2 is an explanation drawing which combines a front view of the punch press and a block diagram of the control unit.
Figure 3:
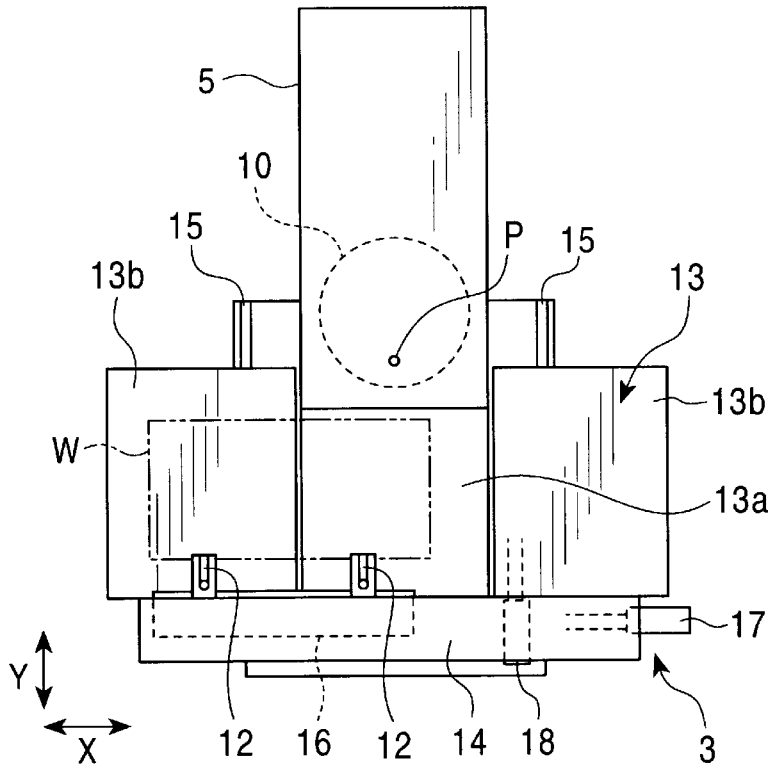
FIG. 3 is a plan view of the punch press.
Figure 4:
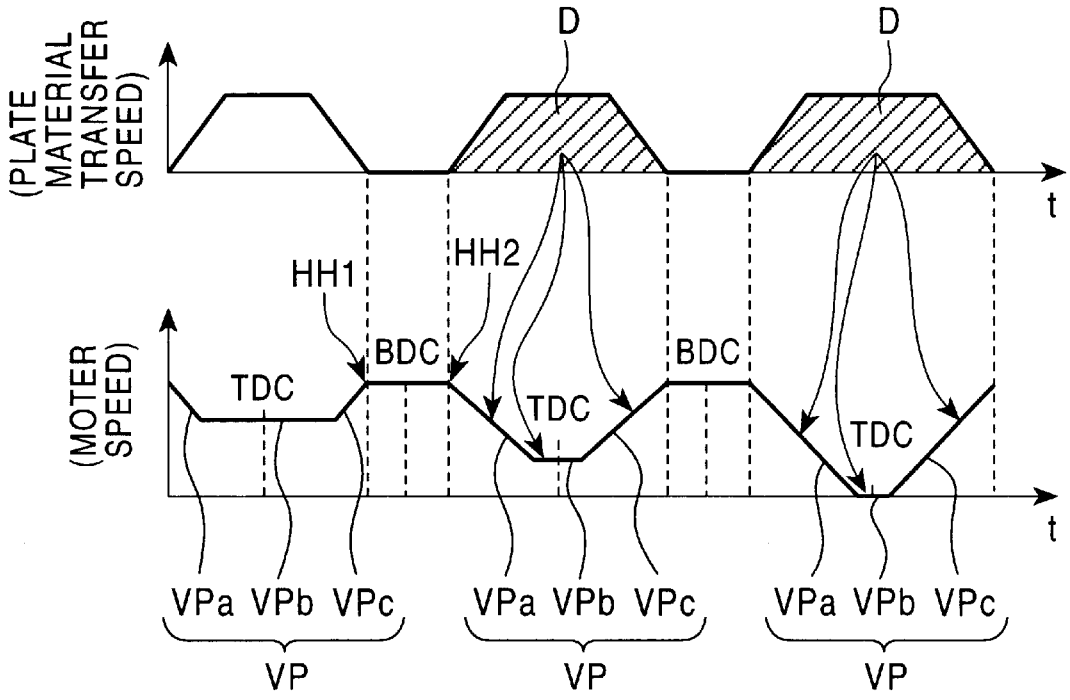
FIG. 4 is a time chart illustrating the relationship between the plate material transfer speed and the motor speed in the punch press.

In the punch press body 1, as illustrated in FIG. 2 and FIG. 3, a plate material transfer means 3 which transfers a plate material W and a process means 4 for punching are installed in a frame 5. The process means 4 comprises a punch drive means 9 for driving a ram 8 which moves a punch tool 6 up and down, and tool support means 10, 11 for supporting the punch tool 6 and a die tool (not shown in the drawings) respectively. The tool support means 10, 11 are composed by a turret installing on the same axis center each other. The punch tool 6 for making holes and/or forming is/are available.

The plate material transfer means 3 is a table device which moves the plate material W to the cross direction (Y-axis direction) and the horizontal direction (X-axis direction) on a table 13 by clamping with a work holder 12. The table device 13 comprises a fixed table 13*a* and a movable table 13*b*, and the movable table 13*b* moves back and forth on a rail 15 of the frame 5 with a carriage 14. A cross slide 16 which can move right and left is installed in the carriage 14 and a plurality of the work holders 12 is installed in the cross slide 16. The carriage 14 and the cross slide 16 are driven by servomotors 17, 18 in each axis through the motion conversion mechanism for a ball screw etc.

The punch drive means 9 has a rotational/linear motion conversion mechanism 20 which converts the rotation of a servomotor 19 into the rise and fall of the ram 8, and moves the punch tool 6 up and down by the ram 8 by making the servomotor 19 a driving force. The ram 8 is installed elevatably in the frame 5 at a predetermined ram position P (FIG. 3) and moves the punch tool 6 in the tool support means 10 determined at the ram position P.

In FIG. 1, the control unit 2 comprising a numeral control unit (NC unit) by the computer and a programmable controller is a program control type that a process program 31 is decoded and executed.

The control unit 2 is equipped with a plate material transfer control means 32 which controls the plate material transfer means 3, a ram axis control means 33 which controls the punch drive means 9, a sequence control means (not shown in the drawings) which controls various sequences in the punch press body 1 and a decoding and execution means 35 which decodes the process program 31 and transmits the command of the process program 31 to the respective control means 32, 33. The plate material transfer control means 32 and the ram axis control means 33 are controlled synchronously by distributing the pulse etc.

The process program 31 is memorized in a program memory 36 or read in the decoding and execution means 35 from the outside. The process program 31 described in a NC code etc. includes a X-axis transfer command and a Y-axis transfer command that is the plate material transfer command which moves the plate material transfer means 3 to the X-axis direction and Y-axis direction respectively, a punch command which transfers the command of rise and fall to the punch drive means 9 and a sequence command (not shown in the drawings) for controlling the sequence motion in each part of the punch press body 1 etc. Moreover, the plate thickness information is described in the attribute information memory part of the process program 31.

The plate material transfer control means 32 for controlling the X-axis and Y-axis servomotors 17, 18 of the plate material transfer means 3 drives the servomotors 17, 18 through a servo controller 39. The plate material transfer control means 32 and the servo controller 39 are provided respectively to the servomotors 17, 18 in each axis, but FIG. 1 illustrates the one to the both axes in one block as an example.

The plate material transfer control means 32 having a synchronous control unit 32*a* controls the plate material transfer means 3 so as to start to transfer the plate material W when the punch tool 6 goes up to a pullout height HH2 (FIG. 1B) not contact with the plate material W after punching the plate material W.

Figure 1A:
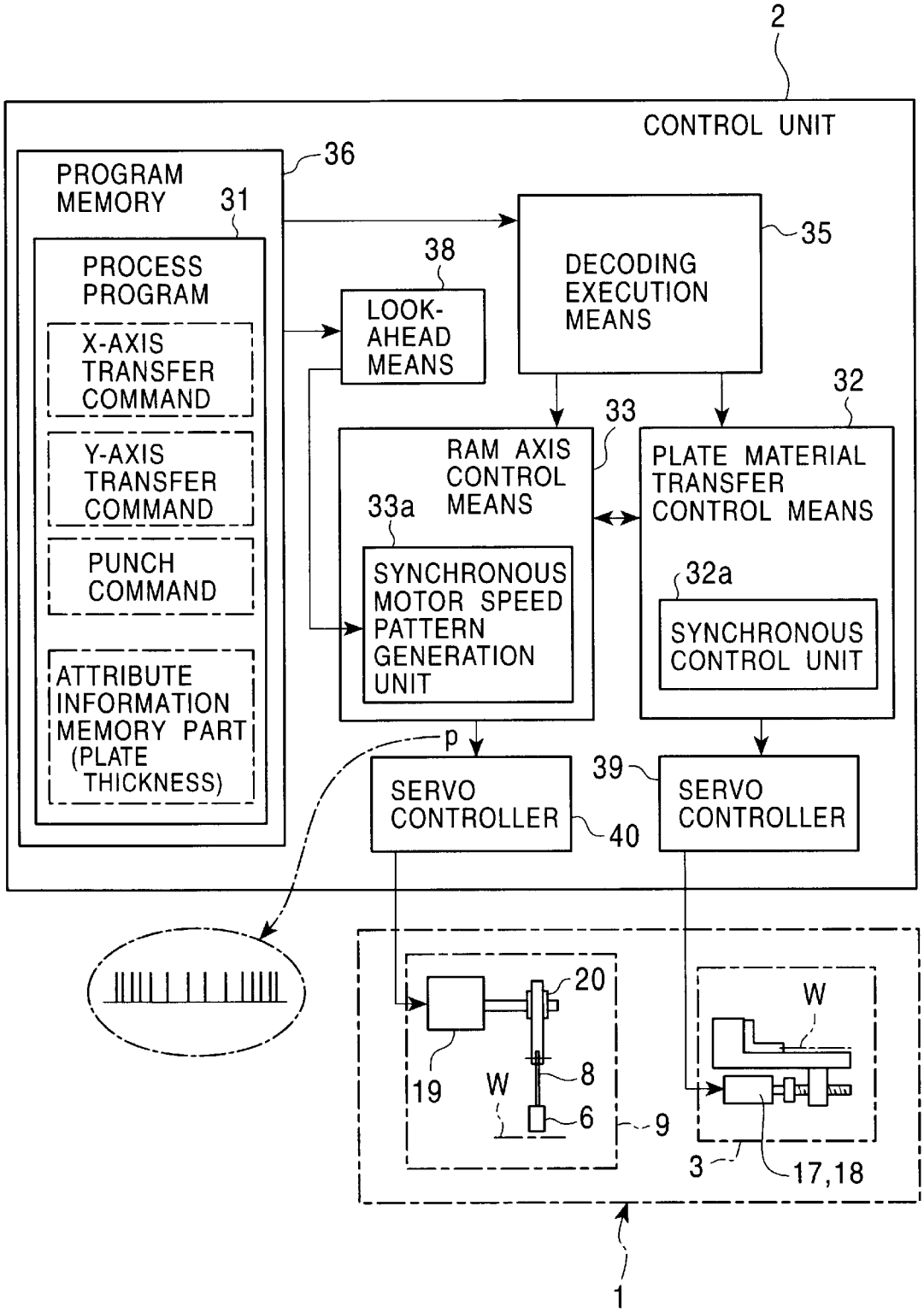
FIG. 1A is a block diagram illustrating a conceptual framework of a punch press control system in a preferred embodiment of the present invention.
Figure 1B:
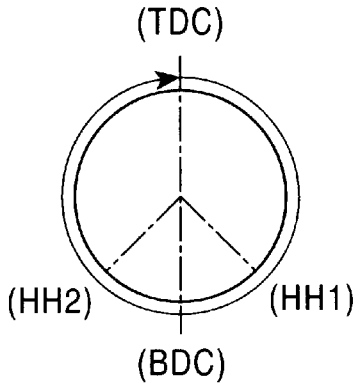
FIG. 1B is an explanation drawing in operating a rotational/linear motion conversion mechanism.
Figure 1C:
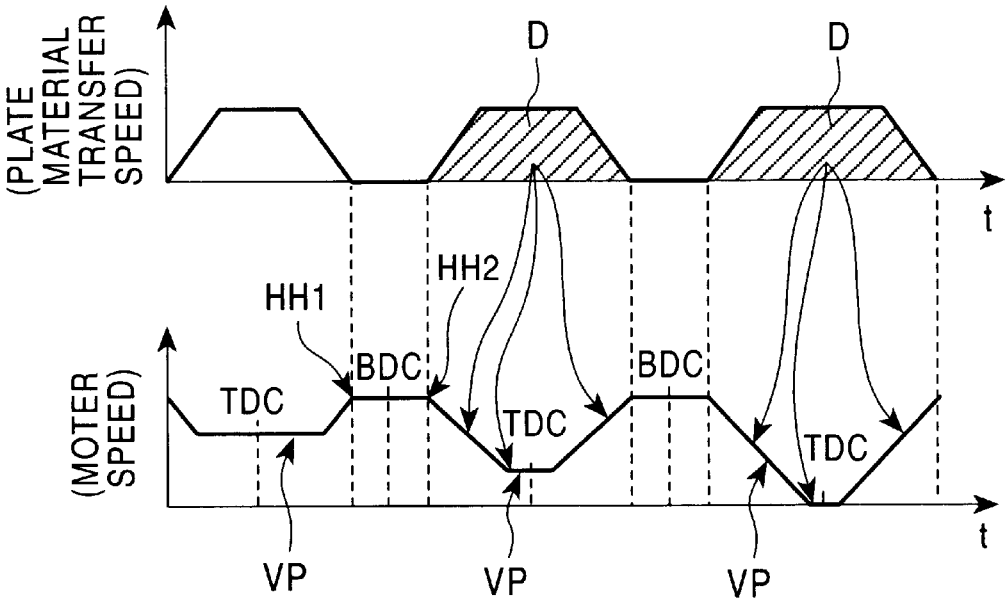
FIG. 1C is general time charts illustrating the relationship between the plate material transfer speed and the motor speed respectively.

The plate material transfer control means 32, as illustrated in FIG. 1C, controls the plate material transfer speed that the speed curve including an acceleration interval that the acceleration is constant, a constant speed interval and a deacceleration interval that the acceleration is constant draws a trapezoid. The area of the trapezoid framed by the plate material transfer speed curve in the same drawing is equal to a plate material transfer distance D.

Moreover, for example, the plate material transfer control means 32 issues the transfer command with sending the pulse and the speed is changed by changing a pulse distribution frequency. In this case, the servo controller 39 is made to be a digital servo which controls the motor current based on the input of a pulse train.

The ram axis control means 33 controls the servomotor 19 of the punch drive means 9 through a servo controller 40. The ram axis control means 33 rotates the rotational/linear motion conversion mechanism 20 in one direction and controls such that the punch tool 6 reaches a height HH1 which is likely to contact with the plate material when the plate material transfer means 3 completes transferring the plate material. Moreover, the ram axis control means 33 generates a motor speed pattern VP that the punch tool 6 goes up from the non-contact pullout height HH2 to the height HH1 which is likely to contact with the plate material through the top dead center TDC based on the plate material transfer distance D, in the said pattern the motor speed not being zero when the plate material transfer distance D is under the predetermined distance. The predetermined distance is optional, however it is not directly set by the distance unit and the calculation method which becomes the generation method of the motor speed pattern VP is set in the preferred embodiment of the present invention and the plate material transfer distance D that the motor speed becomes zero is set as the result of using the calculation method. The plate material transfer distance D becomes the above predetermined distance.

Various standards can be adopted as the generation method of the motor speed pattern VP. For example, the motor speed pattern VP is made to be the pattern that the acceleration in accelerating and deaccelerating is constant regardless of the distance D of transferring the plate material. More specifically, the gradient angle of the acceleration part VPc (FIG. 4B) is made to be constant and the gradient angle of the acceleration part VPa is also constant each other in the curve of every one cycle of the motor speed pattern VP. Moreover, the absolute values of the gradient angles of the acceleration part VPc and the deacceleration part VPa are made to be constant each other.

Furthermore, the motor speed pattern VP having a pattern part VPb of constant speed becomes a trapezoidal (inverted trapezoidal in considering the up and down) speed curve.

The ram axis control means 33 has a synchronous motor speed pattern generation unit 33*a*, wherein the generation method of the motor speed pattern VP is set and the motor speed pattern VP according to the plate material transfer distance D is formed by the generation method. More specifically, the control unit 2 having a look-ahead means 38 which reads the process program 36 earlier than the decoding execution means 35 reads ahead the plate material transfer command following the running punch command with the look-ahead means 38. The synchronous motor speed pattern generation unit 33*a* generates the motor speed pattern VP according to the look-ahead plate material transfer distance D by the established computing equation.

The synchronous motor speed pattern generation unit 33*a* generates the motor speed pattern VP that the servomotor 19 is not stopped as possible, but the interval of stopping the servomotor 19 is generated when the plate material transfer distance D is longer than the predetermined distance. "The servomotor 19 is not stopped as possible" means "the servomotor 19 is not stopped in the area that the effect of energy saving that is the effect can be acquired meaningfully", however the area can be set as follows, to be more precise. For example, if the motor speed pattern VP is made to be a trapezoidal speed curve and the acceleration in accelerating and deaccelerating is constant regardless of the plate material transfer distance D, the part that the speed becomes zero can be generated when the plate material transfer distance D is long as illustrated in the motor speed pattern VP on the right side in FIG. 4. The servomotor 19 is stopped in this case, however the servomotor 19 is not stopped in the other cases.

The ram axis control means 33 gives the transfer command by sending the pulse same as the plate material transfer control means 32 for example and the speed is changed by changing the pulse distribution frequency as illustrated in an example of the pulse train p of FIG. 1A. In the case, a servo controller 40 is served as the digital servo which controls the motor current according to the input of the pulse train. Moreover, the synchronous motor speed pattern generation unit 33*a* generates the pulse train that this pulse distribution frequency is changed on the way.

Additionally, the height HH1 which is likely to contact with the plate material and the pullout height HH2 are the heights only the predetermined excess distance apart from the surface of the plate material W upward and the predetermined excess distance is optional. This predetermined excess distance values of the height HH1 which is likely to contact with the plate material and the pullout height HH2 can be different. The surface position of the plate material W can be acquired from the plate material thickness information set in the process program 31. Moreover, the motor speed pattern VP that is the pattern of the rotating speed of the servomotor 19 has the relationship by the constant function though the elevating speed of the ram 8 is not in proportion to the rotating speed of the servomotor 19 by using the rotational/linear motion conversion mechanism 20. Therefore, the elevating speed of the ram 8 is controlled by the relationship.

The motion in the above configuration will be described. The servomotor 19 is always rotated in one direction in punching, so that the rotational/linear motion conversion mechanism 20 is always rotated in one direction as illustrated in FIG. 1B. The plate material W is punched such as making holes etc. when the ram 8 goes down from the height HH1 which is likely to contact to the bottom dead center BDC during one rotation of the rotational/linear motion conversion mechanism 20. When existing in the height HH1 which is likely to contact, the ram speed reaches the speed suitable for punching (see FIG. 4) and the suitable speed is maintained when going down to the bottom dead center BDC and between the bottom dead center BDC and the pullout position HH2. Moreover, the plate material W is in a halt condition then.

The plate material transfer means 3 starts to transfer the plate material W when the punch tool 6 goes up to the pullout position HH2 and the punch tool 6 reaches the height HH1 which is likely to contact with the plate material when completing transferring the plate material. Thus, the plate material transfer means 3 and the punch drive means 9 are controlled synchronously, so that the wasteful waiting time is not generated and the hit rate is improved.

Moreover, the ram axis control means 33 rotates the rotational/linear motion conversion mechanism 20 in one direction as mentioned above and the ram 8 is prevented from stopping as possible by making the interval going up from the pullout height HH2 to the height HH1 which is likely to contact with the plate material the motor speed pattern VP according to the distance D of transferring the plate material. Thus, the load in accelerating and deaccelerating the servomotor 19 for punch drive is low and the acceleration and deacceleration energy can be low. Thus, the high hit rate and the energy-saving of the punch drive can be realized each other.

The motor speed pattern VP reads the process program 31 ahead with the look-ahead means 38 and is generated by the synchronous motor speed pattern generation unit 33*a* according to the transfer distance of the look-ahead plate material transfer command. Then, as the acceleration is constant regardless of the plate material transfer distance D, the load of calculating the motor speed pattern VP with the computer comprising the control unit 2 can be reduced and the relatively simple computer can also calculate quickly.

Moreover, as the motor speed pattern VP is trapezoidal and has the pattern part VPb of the constant speed, the rapid change in speed is not come out and the ram 8 can move up and down smoothly when not punching and it excels at absorbing the vibration and shock.

Figure 8:
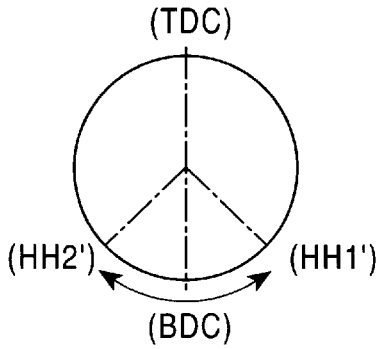
FIG. 8 PRIOR ART
FIG. 8 is an explanation drawing in operating the conventional rotational/linear motion conversion mechanism.
Figure 9:
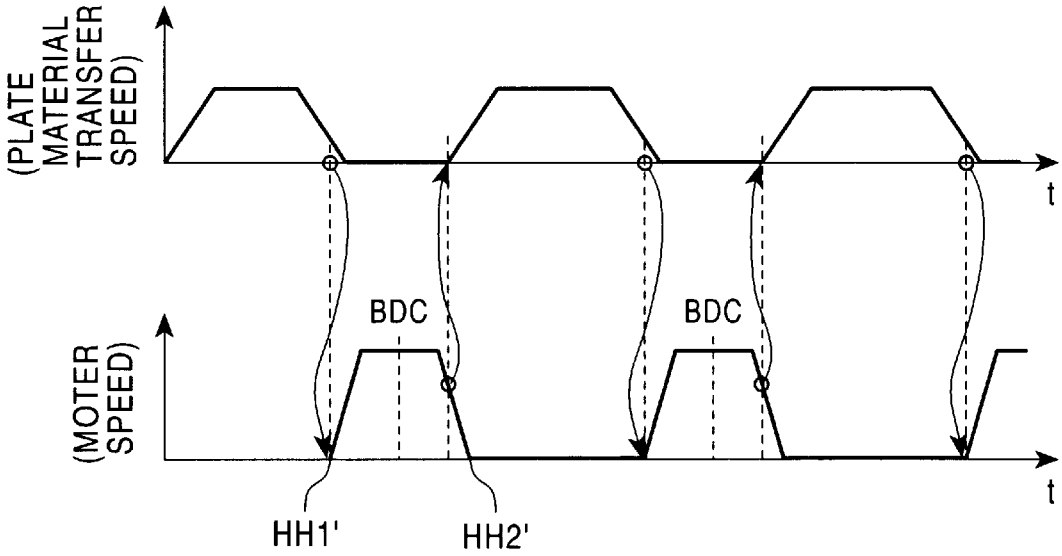
FIG. 9 PRIOR ART
FIG. 9 is a time chart illustrating the relationship between the conventional plate material transfer speed and motor speed.

The following results can be acquired when estimating and comparing the preferred embodiment and the conventional ways as illustrated in FIG. 8 and FIG. 9 with a simulation means.

Each condition of the punch drive means and the necessary energy in the conventional way and the preferred embodiment is set as follows:

| (The conventional way) | |
|---|---|
| Conditions | |
| Necessary punching tonnage (powerful torque) | Tm1 |
| High speed adjustment speed (low inertia) | Jm1 |
| Necessary energies | |
| Punching energy | Wp1 |
| Adjustment speed energy | Wa1 |

| (The preferred embodiment) | |
|---|---|
| Conditions | |
| Necessary punching tonnage (powerful torque) | Tm2 |
| High speed adjustment speed (normal inertia) | Jm2 |
| Necessary energies | |
| Punching energy | Wp2 |
| Adjustment speed energy | Wa2 |

Tm2=Tm1, Jm2=4×Jm1 according to the result of the simulation and the inertia is larger than the conventional way in the preferred embodiment of the present invention and the punch drive means 9 by a versatile servo can be realized.

For example, Wp2=Wp1, Wa2=1/6Wa1 and it can be confirmed that the adjustment speed energy is the sixth part of the conventional one and small in the preferred embodiment and the punching energy is same and the energy saving drive can be realized.

Additionally, though the motor speed pattern VP is trapezoidal which adjusts line speed in the preferred embodiment, it can be the speed pattern of adjusting the curve speed (so-called S-shaped adjustable-speed).

Moreover, the generation method of the motor speed pattern VP with the ram axis control means 33 that is the generation method of the motor speed pattern VP with the synchronous motor speed pattern generation unit 33*a* can be generated such that the acceleration part and the deacceleration part are formed similar to the constant shaped curve for example as well as the above respective examples and the calculation load can be low same as in the case.

Figure 5:
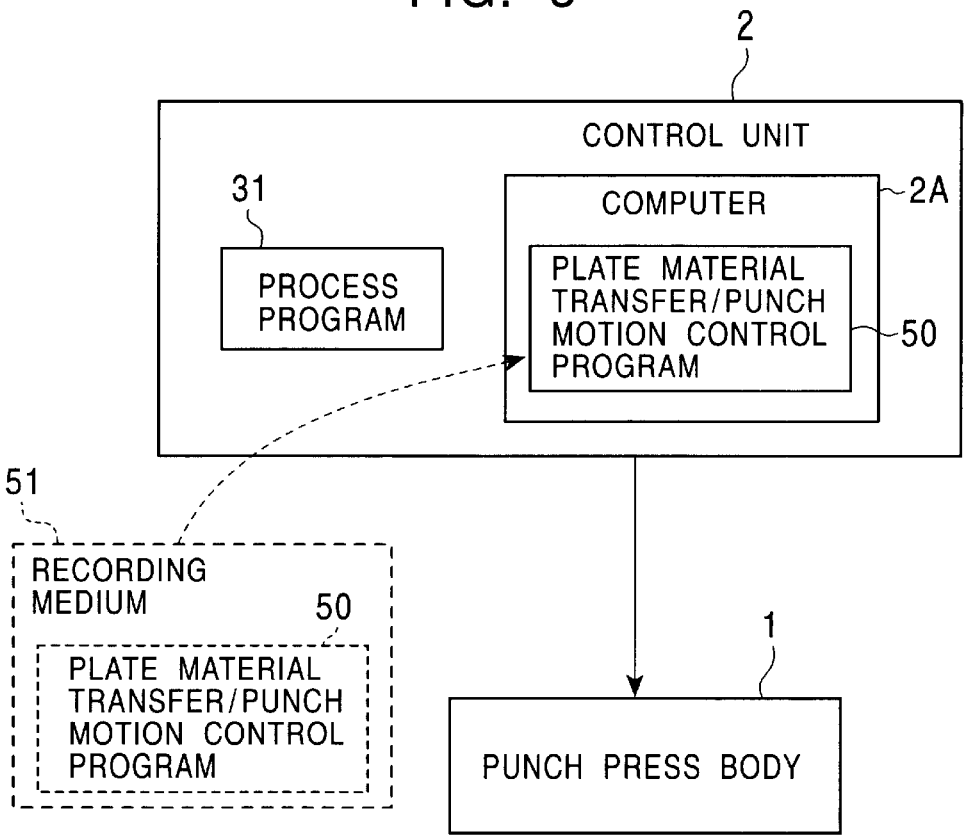
FIG. 5 is a block diagram illustrating the relationship among a plate material transfer/punch motion control program, a computer and a process program in the preferred embodiment of the present invention.

The plate material transfer control means 32 and the ram axis control means 33 etc. in the control unit 2 as described in FIG. 1, as illustrated in FIG. 5, composes of a computer 2A comprising the control unit 2 and a plate material transfer/punch motion control program 50 which can execute in the computer 2A. A recording medium 51 memorizing the plate material transfer/punch motion control program 50 can be read by a recording medium reading unit (not shown in the drawings) in the computer 2A. The recording medium 51 is a compact disc and a magnetic optical disk, for example. Besides, the plate material transfer/punch motion control program 50 can be transmitted from the other computer memorizing the plate material transfer/punch motion control program 50 to the computer 2A through communications line.

The plate material transfer/punch motion control program 50 comprises the plate material transfer control means 32 and the ram axis control means 33 having the following functions. To explain the main point of these control means 32, 33 as described in FIG. 1~FIG. 4 again, the plate material transfer control means 32 controls the plate material transfer means 3 so as to start to transfer the plate material when the punch tool 6 goes up to the pullout height HH2 not contact with the plate material W after punching the plate material W. The ram axis control means 33 for controlling the punch drive means 9 rotates the servomotor 19 in one direction and controls such that the punch tool 6 reaches the height HH1 which is likely to contact with the plate material when completing transferring the plate material with the plate material transfer means 3, and the motor speed pattern that the punch tool 6 goes up from the non-contact pullout height HH2 to the height HH1 which is likely to contact with the plate material through the top dead center TDC is generated according to the distance of transferring the plate material and becomes the pattern that the motor speed is not zero when the distance of transferring the plate material is under the predetermined distance.

Figure 6:
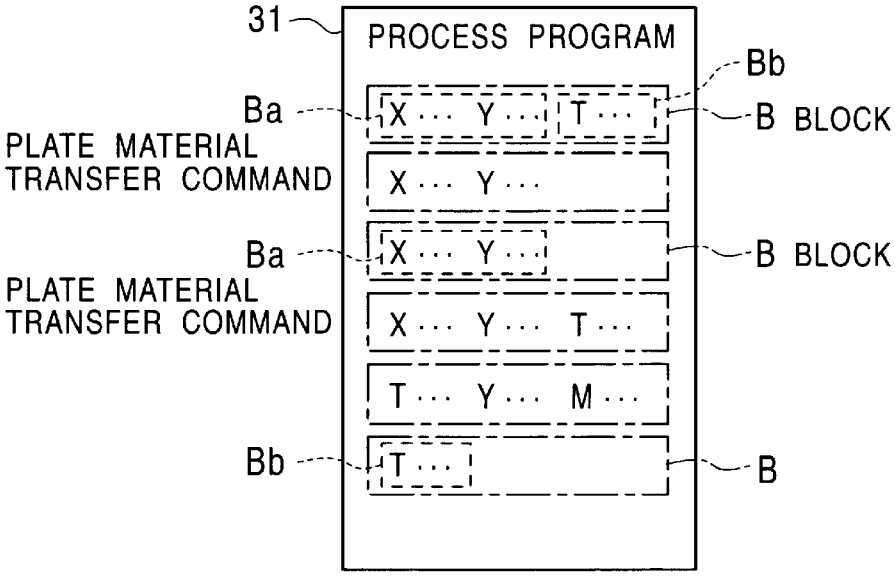
FIG. 6 is an explanation drawing of the configuration of the process program.

FIG. 6 illustrates the constructional example of the process program 31. The process program 31 is illustrated by the transfer command or the punch command in each axis in FIG. 1, but generally composes of an array of a block B executed sequentially as illustrated in FIG. 6. One or a plurality of the various commands such as a plate material transfer command Ba and the tool command Bb is described in each block B. The transfer distance is described after the code such as X or Y showing the transferring direction in the plate material transfer command Ba. In the punch press, the major part of the plate material transfer command Ba is the command that the site of punching the plate material is transferred to the ram position. Thus, in this example, the block B including the plate material transfer command Ba has a meaning of punching after transferring the plate material and the command of not punching is added after the plate material transfer command Ba to the block B of not punching after transferring the plate material with a M code etc. Consequently, the means for decoding the process program 31 in the computer 2A is considered to include the punch command in the block B including the plate material transfer command Ba if not adding a non-punch command.

Figure 7:
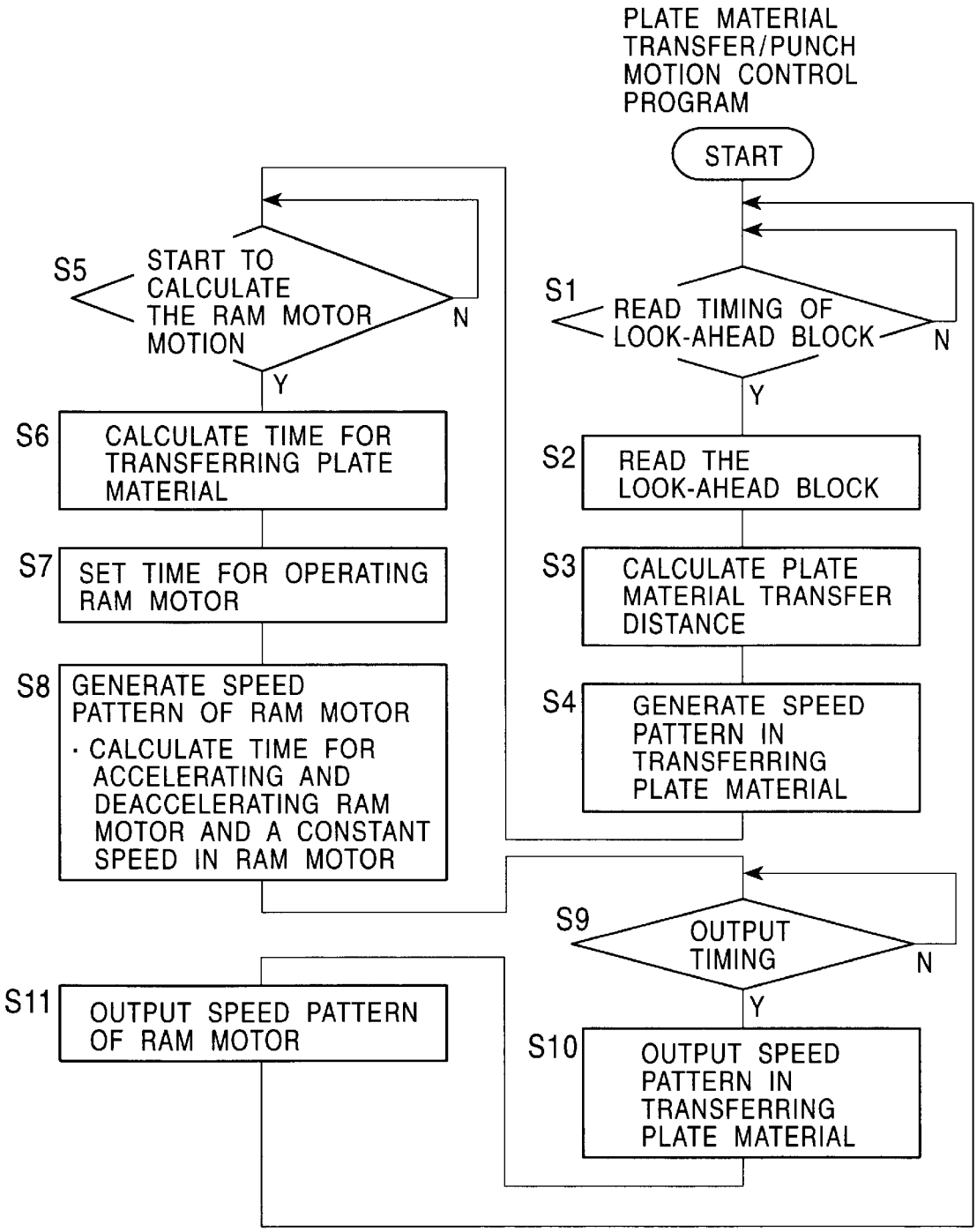
FIG. 7 is a flow chart of an example of the plate material transfer/punch motion control program.

FIG. 7 illustrates the concrete example of the plate material transfer/punch motion control program 50 (FIG. 5), which is a control program of executing the process program 31 described in the block B such as the example in FIG. 6 in the computer 2A by the plate material transfer command that the site of punching the plate material W (FIG. 3) is transferred to the ram position P and includes the following respective steps S1~S11. These steps S1~S11 will be described in turn.

Step S1 is a process of waiting to the read timing of the look-ahead block B and it goes to the next step after becoming the predetermine read timing.

Step S2 is a process of reading the look-ahead block B that is the somethingth block from the running block B for controlling the actual machine motion in the process program 31. The number of the block is set properly. For example, it can be the block B right after the running block B or the second or the third block B after the running block B.

In step S3, the transfer distance D (FIG. 1, FIG. 4) by the plate material transfer command Ba (FIG. 6) is calculated from this read look-ahead block B. This calculation, for example, can be a transfer distance combining the transfer distances to the respective axis directions or a calculation of selecting the transfer distance of the axis direction taking time of transferring to the longer transfer distance and the transferable maximum speed in each axis, and the transfer distance included in the plate material transfer command Ba can be the plate material transfer distance D without change.

Step S4 is a process of generating and memorizing the speed pattern in transferring the plate material of the look-ahead block B from this calculated plate material transfer distance D. The speed pattern in transferring the plate material is made to be a speed pattern of the trapezoid etc. as described in FIG. 1 and FIG. 4.

Step S5 is a process of waiting the time of fulfilling the conditions that the calculation of operating the ram in the following procedures S6~S8 etc. is started. For example, the conditions are fulfilled when reading the block B which is only set. Additionally, this procedure S5 can be omitted.

Step 6 is a process of calculating the plate material transfer time of the look-ahead block B from the above generated speed pattern in transferring the plate material. If the speed pattern in transferring the plate material is decided, the plate material transfer time is settled.

Step S7 is a process of setting the operation time of the ram of the punch drive means 9 in the look-ahead block B from this calculated plate material transfer time. For example, the plate material transfer time is made to be the operation time of the ram 8 when not contacting from the pullout height HH2 to the height HH1 which is likely to contact. It is operated by the predetermined constant ram speed such as a maximum speed between the height HH1 which is likely to contact to the pullout height HH1 through the bottom dead center BDC, so that the operation time is constant between them.

Step S8 is a process of generating and memorizing the motor speed pattern VP (FIG. 1, FIG. 4) in operating the ram when not contacting. The ram motion when not contacting is the motion of the ram 8 that the punch tool 6 reaches the height HH1 which is likely to contact with the plate material through the top dead center TDC after punching the plate material W and going up to the pullout height HH2 not contact with the plate material W by rotating the servomotor 19 driving the ram 8 in one direction. In step S8, the motor speed pattern VP in operating the ram when not contacting is generated such that the ram motion when not contacting is implemented in the calculated ram motion time and the motor speed is not zero when the motion time is under the predetermined time. In the comparison between this set time and the ram motion time, it is enough to compare times as a result and the plate material transfer distance can be compared to the predetermined distance as illustrated in the preferred embodiment. Moreover, on the contrary to this, it is enough to determined the matter "the distance in transferring the plate material is under the predetermined distance" as described in the preferred embodiment and claim 1 etc. in consequence and it can be compared by time.

Thus, the speed pattern in transferring the plate material and the speed pattern VP of the ram 8 in the later block B are generated and memorized by looking ahead and the speed pattern in transferring the plate material and the motor speed pattern VP of the ram 8 are output (S10, S11) at the predetermined output timing (S9). They are outputted to the means which distributes the pulse to the servo controllers 39, 40 (FIG. 1) for example. The means for distributing the pulse can be provided as a part of this plate material transfer/punch motion control program 50 or provided in addition to this control program 50. In case of distributing the pulse in the computer 2A same as the computer 2A which executes the plate material transfer/punch motion control program 50, the pulse distribution and the processes in the respective steps as illustrated in FIG. 7 are implemented at the same time by the interruption process etc.

Thus, the plate material is started to transfer based on the speed pattern in transferring the plate material when the punch tool 6 goes up to the pullout height HH2 after punching the plate material W by using the generated speed pattern in transferring the plate material and the motor speed pattern VP in operating the ram while the actual machine motion is actually controlled by the look-ahead block B generating the speed pattern.

In the punch press of the present invention, the plate material is started to transfer when the punch tool goes up to the pullout height not contact with the plate material with the plate material transfer control means and the ram axis control means, the plate material transfer means and the ram axis control means are controlled synchronously such that the punch tool reaches the height which is likely to contact with the plate material when completing transferring the plate material and the servomotor is rotated in one direction by the ram axis control means to the motor speed pattern that the punch tool goes up from the non-contact pullout height and the height which is likely to contact with the plate material is generated according to the plate material transfer distance and the servomotor is prevented from stopping as possible, so that the high hit rate and the energy saving of the punch drive can be realized together.

The calculation load in the control system is low if the acceleration when accelerating and deacceletating in the motor speed pattern is constant regardless of the distance of transferring the plate material and the high hit rate and the energy saving can be realized by the simple control.

If the motor speed pattern has a constant speed pattern part, the ram can be moving up and down smoothly when not punching and it excels at absorbing the vibration and shock.

The plate material transfer/punch motion control program of the present invention can realize the high hit rate in the punch press and the energy saving in the punch drive.

What is claimed is:

1. A punch press which makes holes and/or forms in a plate material with a punch tool, the punch press comprising:

a plate material transfer means which transfers the plate material;

a punch drive means which includes a rotational/linear motion conversion mechanism which converts the rotation of a servomotor into the rise and fall of a ram and moves the punch tool up and down with the ram, using the servomotor a driving force for the punch tool a plate material transfer control means which controls the plate material transfer means; and, a ram axis control means which controls the punch drive means, the plate material transfer control means controlling the plate material transfer means so as to start to transfer the plate material when the punch tool goes up to a separation/contact height at which the punch is no longer in contact with the plate material, after punching the plate material; and, the ram axis control means rotating the servomotor in one direction, the punch tool being controlled so as to reach the separation/contact height and make contact with the plate material after completing transfer of the plate material with the plate material transfer means; and, as the punch tool goes up from the separation/contact height and returns to the separation/contact height through a top dead center, the ram axis control means controls motion of the punch tool based on an expected distance of transferring the plate material;

wherein the motor speed does not reach zero when the expected distance of transferring the plate material is under predetermined distance and the motor speed reaches zero when the expected distance of transferring the plate material is over the predetermined distance.

2. The punch press of claim 1, wherein the ram axis control means keeps a magnitude of an acceleration of the punch tool constant regardless of the expected distance of transferring the plate material.

3. The punch press of claim 1 or claim 2, wherein a rotation speed of the servomotor is constant.

4. The punch pre of claim 1, wherein the ram axis control means comprises an apparatus to determine the expected distance.

5. A plate material transfer/punch motion control program for running a computer controlling a plate material transfer control means and a ram axis control means of a punch press which makes holes and/or forms in a plate material with a punch tool, the punch press comprising a plate material transfer means which transfers the plate material, and a punch drive means including a rotational/linear motion conversion mechanism which converts the rotation of a servomotor into the rise and fall of a ram and moves the punch tool up and down with the ram, using the servomotor a driving force for the punch tool; the program comprising:

instructions to the plate material transfer control means to control the plate material transfer means such that he plate material starts to transfer when the punch tool goes up to a separation/contact height at which the punch is no longer in contact with the plate material, after punching the plate material, and, instructions to the ram axis control means to control the punch drive means, by rotating the servomotor in on direction, such that the punch tool comes down to the separation/contact height at which is likely to contact with the plate material after completing the transfer of the plate material by the plate material transfer means; and instructions to control a speed of the servomotor while the punch tool goes up from the separation/contact height back down to the separation/contact height through the top dead center based on an expected distance of transferring the plate material; and instructions to maintain the servomotor speed above zero when the expected distance of transferring the plate material is under a predetermined distance.

6. A computer readable recording medium on which is recorded the plate material transfer/punch motion control program of claim 5.

7. A computer program comprising a plate material transfer/punch motion control program which is executed in a computer controlling a punch press, the program including a plate material transfer command of transferring a site of punching plate material to a position of a ram of the punch press, positions of the am being divided into blocks in the program; the program comprising the steps of:

reading a look-ahead bloc that is an nth block from a running block, wherein the running block controls a presently ongoing machine motion;

calculating an expected transfer distance of the nth look-ahead block;

generating and recording in a memory a transfer speed pattern of transferring the plate material during the nth look-ahead block from the plate material expected transfer distance;

calculating a time for transferring the plate material during the look-ahead block from the transfer speed pattern of transferring the plate material;

setting a time for operating the ram of the punch drive means in the nth look-ahead block from the calculated plate material transfer time;

generating and recording in the memory a motor speed pattern of the ram motion in the nth look-ahead block, during a ram motion during which the punch passes from a separation/contact height at which the punch is likely to separate from the plate material, passes a top dead center position, and moves back to the separation/contact height at which the punch is likely to contact the plate material, the ram motion being caused by rotating a servomotor in one direction of rotation, wherein the motor speed is not zero when the ram motion time is under a predetermined time; and, starting to transfer the plate material based on the transfer speed pattern of transferring the plate material when the punch to goes up to the separation/contact height after processing the plate material by using the transfer speed pattern in transferring the plate material and the motor speed pattern of the ram motion while the motion of the machine is controlled with the nth look-ahead block.

8. A computer readable recording medium on which is recorded the plate material transfer/punch motion control program of in claim 7.

* * * * *